US008286268B2

(12) United States Patent
Yamashita et al.

(10) Patent No.: US 8,286,268 B2
(45) Date of Patent: Oct. 16, 2012

(54) FREELY CUTTABLE GARMENT

(75) Inventors: Mizue Yamashita, Osaka (JP); Naoko Fujimoto, Osaka (JP); Hitomi Arimura, Osaka (JP); Akira Nakai, Osaka (JP); Tsutomu Suzuoki, Hyogo (JP); Shinobu Tabata, Hyogo (JP); Masayuki Tani, Hyogo (JP); Taisuke Yamamoto, Hyogo (JP)

(73) Assignee: Gunze Limited, Ayabe-Shi (JP)

( * ) Notice: Subject to any disclaimer, the term of this patent is extended or adjusted under 35 U.S.C. 154(b) by 727 days.

(21) Appl. No.: 11/886,591

(22) PCT Filed: Apr. 1, 2005

(86) PCT No.: PCT/JP2005/006471

§ 371 (c)(1),
(2), (4) Date: Oct. 19, 2007

(87) PCT Pub. No.: WO2006/114816

PCT Pub. Date: Nov. 2, 2006

(65) Prior Publication Data

US 2009/0007309 A1 Jan. 8, 2009

(51) Int. Cl.
*A41D 27/10* (2006.01)

(52) U.S. Cl. ..... 2/269

(58) Field of Classification Search ..... 2/75, 80, 2/69, 72, 114, 269; 66/176
See application file for complete search history.

(56) References Cited

U.S. PATENT DOCUMENTS

| | | | | | |
|---|---|---|---|---|---|
| 1,499,220 | A | * | 6/1924 | Katzman | 206/574 |
| 1,934,282 | A | * | 11/1933 | Telzerow | 33/12 |
| 1,982,005 | A | * | 11/1934 | Hutter | 33/12 |
| 2,211,410 | A | * | 8/1940 | Du Pont | 33/12 |
| 2,227,214 | A | * | 12/1940 | Bisberg | 2/73 |
| 2,669,726 | A | * | 2/1954 | Meisel | 2/221 |
| 2,724,120 | A | * | 11/1955 | Biern | 2/211 |
| 2,985,887 | A | * | 5/1961 | Lindley | 2/211 |
| 3,229,875 | A | * | 1/1966 | Stoller | 225/38 |
| 3,380,075 | A | * | 4/1968 | Marthinsson | 2/126 |
| 3,406,407 | A | * | 10/1968 | Parlanti | 2/243.1 |

(Continued)

FOREIGN PATENT DOCUMENTS

EP 1 233 091 A1 8/2002

(Continued)

OTHER PUBLICATIONS

Olive C. Hapgood., 1893-School Needlework, Feb. 28, 2005, pp. 1-18. XP-002491655.

*Primary Examiner* — Alissa L Hoey
(74) *Attorney, Agent, or Firm* — Birch, Stewart, Kolasch & Birch, LLP

(57) ABSTRACT

A freely cuttable garment is provided. The freely cuttable garment is capable of being cut by a consumer into any design shape for use. The garment is formed of a fray-preventing knitted fabric woven with heat-welding elastic yarn. Sizes of opening parts of the neck, side, and bottom of the garment are smaller than those of a standard product; a total length and sleeve length of the garment are larger than those of the standard product; and a body width, cuff, waist, and lower bottom edge of the garment are equal to those of the standard product. The garment can be cut into any design shape and can be used with the opening parts left cut-off.

4 Claims, 9 Drawing Sheets

U.S. PATENT DOCUMENTS

| | | | | | |
|---|---|---|---|---|---|
| 3,578,546 | A | | 5/1971 | Morancy | |
| 3,796,066 | A | | 3/1974 | Millar | |
| 3,816,924 | A | * | 6/1974 | Cutri | 33/17 R |
| 3,845,506 | A | * | 11/1974 | Harris | 2/409 |
| 3,979,831 | A | * | 9/1976 | Lutz | 33/17 R |
| 3,985,003 | A | * | 10/1976 | Reed | 66/196 |
| 4,118,802 | A | * | 10/1978 | Polster | 2/84 |
| 4,860,900 | A | * | 8/1989 | Forschner | 206/574 |
| 5,173,965 | A | * | 12/1992 | Panner | 2/105 |
| 6,055,673 | A | * | 5/2000 | McCormick | 2/227 |
| 6,240,561 | B1 | * | 6/2001 | McGinnis | 2/69.5 |
| 6,327,711 | B1 | * | 12/2001 | Fujiwara | 2/69 |
| 6,389,850 | B1 | * | 5/2002 | Fujiwara | 66/176 |
| 6,401,498 | B1 | | 6/2002 | Fujiwara | |
| 6,408,438 | B1 | * | 6/2002 | McKee | 2/69 |
| 6,453,705 | B2 | * | 9/2002 | Fujiwara | 66/176 |
| 6,776,014 | B1 | | 8/2004 | Laycock et al. | |
| 6,823,700 | B1 | * | 11/2004 | Yi | 66/192 |
| 7,013,680 | B1 | * | 3/2006 | Adams | 66/172 R |
| 7,350,861 | B2 | * | 4/2008 | Zaharakos | 297/228.1 |
| 7,441,281 | B2 | * | 10/2008 | Salem | 2/115 |
| 2003/0204892 | A1 | * | 11/2003 | Vafi | 2/67 |
| 2004/0006878 | A1 | * | 1/2004 | Grove | 33/17 R |
| 2004/0016041 | A1 | * | 1/2004 | Uno et al. | 2/113 |
| 2004/0016043 | A1 | * | 1/2004 | Uno et al. | 2/400 |
| 2004/0064869 | A1 | * | 4/2004 | Deadwyler | 2/115 |
| 2004/0237599 | A1 | * | 12/2004 | Kondou et al. | 66/202 |
| 2005/0044604 | A1 | * | 3/2005 | Salem | 2/69 |

FOREIGN PATENT DOCUMENTS

| | | | |
|---|---|---|---|
| GB | 1159113 | | 7/1969 |
| JP | 14-10128 | Y1 | 7/1939 |
| JP | 47-20306 | Y1 | 7/1972 |
| JP | 49-13467 | A | 4/1974 |
| JP | 49-13467 | B1 | 4/1974 |
| JP | 59-150143 | A | 8/1984 |
| JP | 4-352839 | | 12/1992 |
| JP | 5-56903 | U | 7/1993 |
| JP | 7-12407 | U | 2/1995 |
| JP | 7-28902 | U | 5/1995 |
| JP | 08-209424 | A | 8/1996 |
| JP | 11-81073 | A | 3/1999 |
| JP | 3059876 | U | 7/1999 |
| JP | 11-229205 | A | 8/1999 |
| JP | 3068931 | U | 5/2000 |
| JP | 2002-146609 | A | 5/2002 |
| JP | 2003-147618 | A | 5/2003 |
| JP | 2003-201654 | A | 7/2003 |
| JP | 2003-253510 | A | 9/2003 |
| JP | 2003-268603 | A | 9/2003 |
| JP | 2004-27465 | A | 1/2004 |
| JP | 2005-113349 | A | 4/2005 |
| SU | 1 498 845 | A1 | 8/1989 |
| WO | WO-03/093551 | A1 | 11/2003 |

* cited by examiner

FIG.6

| Product | Pattern | Neckline | Sleeve length | Total length | Body width |
|---|---|---|---|---|---|
| Long-sleeve shirt type | Standard | 60 | 55 | 58 | - |
| | Original A | 30 | 60 | 65 | - |
| Non-sleeve shirt type | Standard | 60 | - | 58 | - |
| | Original B | 30 | - | 65 | - |
| Product | Pattern | Waist girth | Rise length | Total length | Body width |
| Long-length panty type | Standard | - | 30 | 88 | - |
| | Original C | - | 38 | 94 | - |
| Half-length panty type | Standard | - | 30 | 48 | - |
| | Original D | - | 38 | 52 | - |

FREELY CUTTABLE GARMENT

TECHNICAL FIELD

The present invention relates to a freely cuttable garment that is designed to be capable of being, after purchased, freely cut by a purchaser into any design shape so that the purchaser can wear the garment.

BACKGROUND ART

Conventionally, typical commercially available garments are commercialized and marketed after going through manufacturing processes, such as fabric cutting, sewing, and finish processing, in accordance with predetermined design, shape, and size. A consumer, from among marketed products (garments), selects a product that fits his or her favorite design shape and his or her own size, and purchases and directly wears the product.

Conventionally proposed for a formal dress, such as a wedding dress, a cocktail dress, an evening dress, or the like, is the one which is marketed in a set of cloth parts left cut (not sewn) for different parts of one garment so that a purchaser can select his or her desired design from among several predetermined combination designs of the different cloth parts and then perform sewing on the different cloth parts to tailor the garment (see Patent Document 1).

[Patent Document 1] Japanese Unexamined Patent Publication No. HEI08-209424

DISCLOSURE OF THE INVENTION

Problems to be Solved by the Invention

In recent years, due to increasingly diversified and personalized fashions, there has been an increasing demand for a variable garment that can be, after purchased, freely cut by a purchaser into any design shape so that the purchaser can modify the garment in accordance with his or her own preference and then wear the garment.

However, the garment of Patent Document 1 only permits the purchaser to select his or her desired design from among the several combination designs after the product purchase and cannot be freely cut and modified into any design by the purchaser. Moreover, the garment of Patent Document 1 causes a problem that the purchaser is required to sew the different cloth parts to finish the garment after the product purchase, which requires a high level of sewing processing techniques for this sewing and finishing. On the other hand, a conventional garment as a ready made product, which is worn directly after purchased, is not designed to be cut freely and cannot be freely modified into a preferred design, thus failing to satisfy the demand described above.

It is an object of the present invention to provide a garment which can be, after purchased, freely cut by a purchaser into any design shape so that the purchaser can wear it and which has a cut-off part requiring no high level cutting and sewing processing techniques.

Means Adapted to Solve the Problems

To solve the problem described above, the present invention refers to a garment capable of being cut by a consumer into any design shape for use. The garment is formed of a fray-preventing knitted fabric woven with heat-welding elastic yarn and has an original pattern, in which sizes of opening parts of a neck, a side, a bottom, and the like of the garment are smaller than sizes of opening parts of a neck, a side, a bottom, and the like of a standard product; a total length and a sleeve length of the garment are larger than those of the standard product; and a body width, a cuff, a waist, and a lower bottom edge of the garment are equal to those of the standard product. The standard product described above means a garment whose individual parts are fabricated in dimension suitable for a standard body type by each model number (for example, S, M, L, and the like) or each size number (for example, 13, 15, or the like) representing measure and shape of each garment type.

A standard cut line may be displayed on either of back and front sides of the garment by printing or otherwise, and also or instead thereof, a cuttable design model may be displayed on wrapping paper or a board of the garment by printing or otherwise and wrapped together with the garment as a set. The standard cut line means an illustration of a cut position and a cut shape.

The original pattern of the garment is selected from among a long-sleeve shirt type, a non-sleeve shirt type, a long-length panty type, and a half-length panty type.

The fray-preventing knitted fabric is circular knitted fabric woven with heat-welding polyurethane elastic yarn and other spun yarn or filament yarn by plating stitch.

The cuttable design model displayed on the wrapping paper or the board is expressed in transition from the long-sleeve shirt type to a half-sleeve shirt type and further to the non-sleeve shirt type and the like, and also from the long-length panty type to a short panty type and further to a shorts type and the like.

A portion cut across each seaming part of components of the garment is provided as a seam by heat welding means.

The garment has a part or all of a circumferential edge of at least one of opening parts provided with cut-off design formed in a curved line, and is formed of fray-preventing knitted fabric.

The present invention is applied to an undershirt whose opening part provided with the cut-off design is at least one of a neckline part, an armhole part, a cuff part, and a bottom circumference part.

The present invention is applied to pants whose opening part provided with the cut-off design is at least one of a waistline part and a bottom circumference part.

Effectiveness of the Invention

According to the present invention, a garment is formed of a fray-preventing knitted fabric woven with heat-welding elastic yarn, so that the garment does not fray even when cut anywhere; therefore, the garment can be used while left cut-off. Moreover, sizes of opening parts of the neck, side, bottom, and the like of this garment are smaller than those of a standard product; a total length and a sleeve length of the garment are larger than those of the standard product; and a body width, a cuff, a waist, and a bottom edge of the garment are equal to those of the standard product. Thus, a purchaser can freely cut the purchased garment into any design shape and then wear the garment. Moreover, since the cut portions can be used while left cut-off, high-level cutting and sewing processing techniques are not required, thus permitting providing a garment adapted to diversification and personalization of fashions.

Moreover, displaying a standard cut line on either of the back and front sides of the garment by printing or otherwise permits even a beginner to easily perform cutting with reference thereto. Further, displaying a cuttable design model on a wrapping paper or a board by printing or otherwise and wrapping the wrapping paper or the board together with the garment as a set permits cutting into various modes with reference thereto. Furthermore, providing a portion cut across each seaming part of components of the garment as a seam by heat-welding means permits preventing the portion cut at the seaming part from fraying.

Moreover, the garment formed of fray-preventing knitted fabric and having opening parts with cut-off design requires no fray-stopping after treatment (sewing or the like) on the circumferential edges of the opening parts, and can realize no outlet seam and improve a wear feeling; therefore, this garment is suitable for thin garments.

BRIEF DESCRIPTION OF THE DRAWINGS

FIG. 6 is a chart showing one example of dimensions and sizes of different parts with respect to original patterns and standard products for the respective garments according to the present invention.

DESCRIPTION OF REFERENCE NUMERALS

Figure 1:
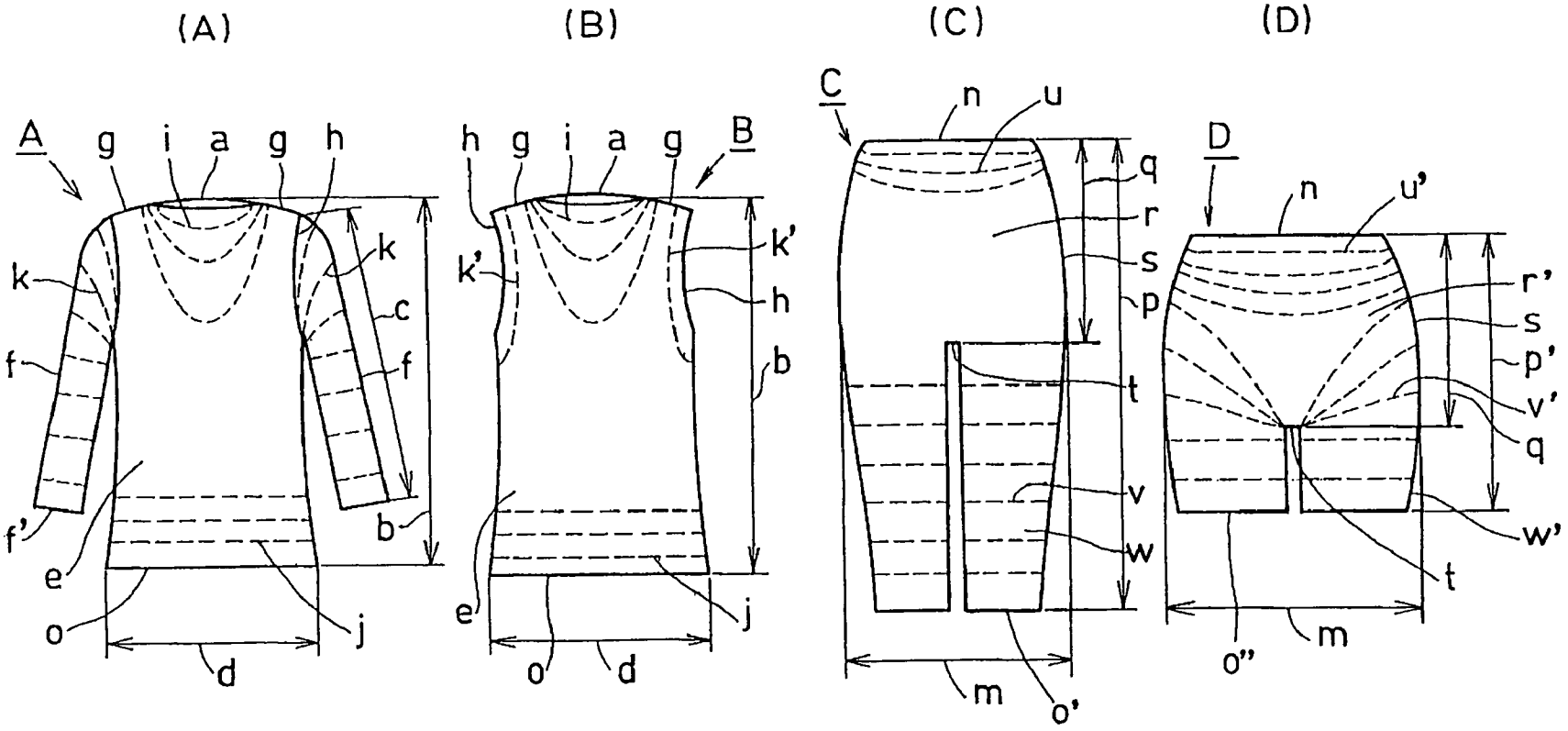
FIGS. 1A, 1B, 1C, and 1D are schematic elevation views of original patterns for four types of garments according to the present invention.

A. Original pattern for a long-sleeve shirt type garment
A1-A8. Modified modes thereof
B. Original pattern for a non-sleeve shirt type garment
B1-B3. Modified modes thereof
C. Original pattern for a long-length panty type garment
C1-C7. Modified modes thereof
D. Original pattern for a half-length panty type garment
D1-D4. Modified modes thereof
1. Front body
2. Back body
3. Armhole part
4. Neckline part
5. Bottom circumference part
6. Flank part
7. Shoulder part
8. Seaming part

BEST MODE FOR CARRYING OUT THE INVENTION

Hereinafter, embodiments of a garment according to the present invention will be described with reference to the accompanying drawings. FIG. 1 shows original patterns A to D for garments: (A) a long-sleeve shirt type, (B) a non-sleeve shirt type (C), a long-length panty type, and (D) a half-length panty type, respectively. Fabric forming the original patterns A to D for these garments is a fray-preventing knitted fabric woven from the heat-welding elastic yarn. This fray-preventing knitted fabric is circular knitted fabric woven with heat-welding polyurethane elastic yarn and other spun yarn or filament yarn by plating stitch.

The plating stitch described above is a method of feeding a plurality of types of yarn to a knitting needle through mutually different yarn-feeding openings, and serves to stably define arrangement of the yarn of each knitted loop. Therefore, the plating-knitted fabric woven by feeding the heat-welding elastic yarn and a different type of yarn to the knitting needle through the different yarn-feeding openings, due to its stable arrangement of the heat-welding elastic yarn and the different type of yarn in each knitted loop, can locate the heat-welding elastic yarn adjacent to all the loops. Thus, additionally providing fray-preventing function by melting the heat-welding elastic yarn through heat setting processing or the like provides complete fray-prevention for all the loops of the knitted fabric, so that the plating-knitted fabric advantageously does not fray even when cut anywhere.

The original patterns for the garments formed of the knitted fabric described above are fabricated in the following manner.

First, as shown in FIG. 1(A), by using the circular knitted fabric described above, the original pattern A for the long-sleeve shirt type garment is made in a manner such that the size of an opening part of a neckline a is smaller, a total length b and a sleeve length c are larger, and a body width d, a cuff f', and a bottom edge o are equal, all with respect to those of a standard product. In this case, front and back bodies e are formed with the circular knitted fabric corresponding to the body width d, and a sleeve part f is formed of a sleeve part f prepared by welding a sleeve part cut from circular knitted fabric or one piece of fabric by heat-welding means and forming this sleeve part into a cylindrical shape. A seaming part for shoulder parts g of the front and back bodies e is a seam formed by the heat-welding means. A seaming part between an armhole part h and an end part of the sleeve part f is sewed in a normal manner. The heat-welding means is the one which achieves seaming by placing a heat-welding tape at the seaming part and hot-pressing it with an iron or the like. Then standard cut lines i, j, and k for the neckline a, the total length b, and the sleeve length c, respectively, are displayed on the front or back sides of the garment by printing or the like. One or a plurality of each of the standard cut lines i, j, and k for the neckline a, the total length b, and the sleeve length c, respectively, are displayed at different positions, in different shapes, and the like.

Next, by using the circular knitted fabric described above, as shown in FIG. 1(B), the original pattern B for the non-sleeve shirt type garment is made in a manner such that sizes of opening parts of a neckline a and an armhole part h are smaller, a total length b is larger, and a body width d and a bottom edge o are equal, all with respect to those of a standard product. In this case, front and back bodies e are formed with the circular knitted fabric corresponding to the body width d, and a seeming part for shoulder parts g of the front and back bodies e is a seam formed by the same heat-welding means as described above. Then standard cut lines i, j, and k' for the neckline a, the armhole part h, and the total length b, respectively are displayed on the front or back sides of the garment by printing or the like. One or a plurality of each of the standard cut lines i, j, and k' for the neckline a, the armhole part h, and the total length b, respectively, are displayed at different positions, in different shapes, and the like.

In addition, the original pattern C for the long-length panty type garment is formed by cutting the circular knitted fabric described above or one piece of fabric open into left and right separate portions or front and back separate portions and then seaming together the left and right portions or the front and back portions. Then as shown in FIG. 1(C), the pattern C is made in a manner such that sizes of opening parts of a body width m, a waist girth n, and a bottom edge o' are equal and a total length p and a rise length q are larger, all with respect to those of a standard product. In this case, front and back bodies r are formed with circular knitted fabric corresponding to the body width m and the waist girth n or one piece of open fabric, and the total length p and the rise length q are cut larger than those of the standard product, and seaming parts for both sides s, crotch parts t, and the like are seams formed by the same heat-welding means as described above. Then standard cut lines u and v for the waist girth n and a leg part w, respectively, are displayed on the front or back side of the garment by printing or the like. One or a plurality of each of the standard cut lines u and v for the waist girth n and the leg part w, respectively, are displayed at different positions, in different shapes, and the like.

In addition, the original pattern D for the half-length panty type garment is formed by cutting the circular knitted fabric described above or one piece of open fabric into left and right separate portions or front and back separate portions and then seaming together the left and right portions or the front and back portions. Then as shown in FIG. 1(D), the original pattern D is made in a manner such that sizes of opening parts of a body width m, a waist girth n, and a bottom edge o" are equal and a total length p' and a rise length q' are larger, all with respect to those of a standard product. Also in this case, as is the case with the long-length panty type, front and back bodies r' are formed with circular knitted fabric corresponding to the body width m and the waist girth n or one piece of open fabric, the total length p' and the rise length q' are cut larger than those of the standard product, and seaming parts for both sides s, crotch parts t, and the like are seams formed by the same heat-welding means as described above. Then standard cut lines u' and v' for the waist girth n and a leg part w', respectively, are displayed on the front or back side of the garment by printing or the like. One or a plurality of each of the standard cut lines u' and v' for the waist girth n and the leg part w', respectively, are displayed at different positions, in different shapes, and the like.

A method of displaying the cut lines of the respective original patterns for the garments is performed by a transfer method or a hand printing method. The transfer method is a method in which cut lines are previously printed on a transfer paper and then this transfer paper is laid on the fabric surface, to which heat is added to thereby transfer the cut lines printed on the transfer paper onto the fabric. The hand printing method is a method in which, with dye-containing paste (colored paste) placed on a screen (gauze woven with nylon or the like), the cut lines are dyed into the fabric surface by rubbing the colored paste there against through the screen cells with a spatula. In this case, used as the screen is the one whose cells are previously closed by a film or the like with the cells of the printed portion opened to form a pattern.

Moreover, the present invention displays standard cut lines on the back or front side of the garment as described above, and also displays cuttable design models on wrapping paper or board of each garment by printing or the like.

Figure 2:
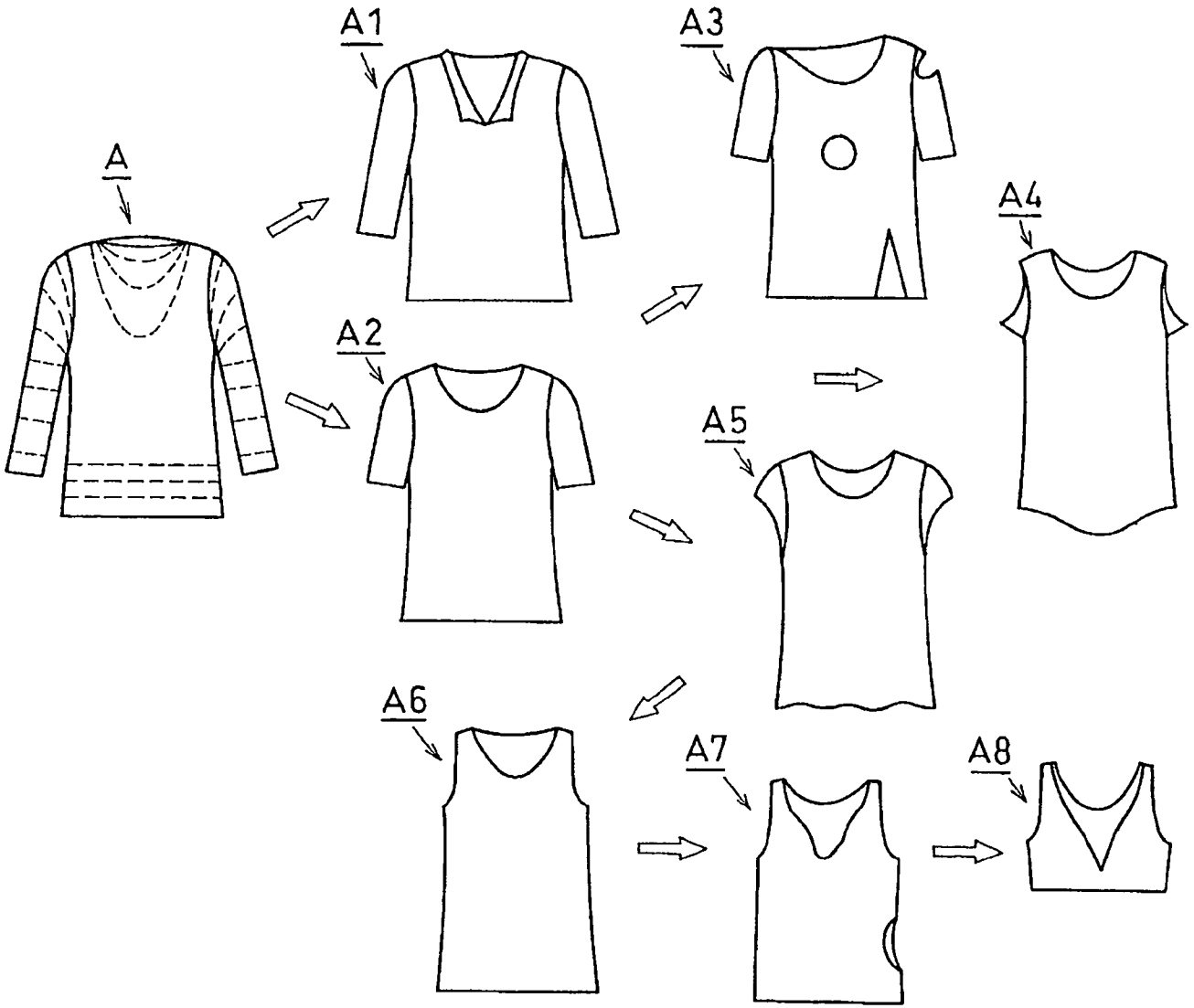
FIG. 2 is an illustrative diagram showing a display example of cuttable design models for a long-sleeve shirt type.

FIG. 2 shows cuttable design models displayed on the wrapping paper or board of the long-sleeve shirt type garment by printing or the like, expressing possible transition from the original pattern A to modified patterns A1 and A2, further to modified patterns A3, A4, and A5, and further to modified patterns A6, A7, and A8. The pattern A1 refers to a long-sleeve shirt provided by cutting the sleeve length and total length of the original pattern A short, cutting the neckline thereof into a V-neck shape, and cutting the bottom of the V-neck vertically short and folding it over to the both sides to thereby form collars. The pattern A2 refers to a case where the original pattern A is deformed into a round-neck half-sleeve shirt. The pattern A3 refers to a case where a V-cut is provided in the bottom of the pattern A2, a U-cut is provided in the sleeve thereof, and a round cut is provided in the front body thereof. The patterns A4 and A5 refer to a case where the sleeves and bottom of the pattern A2 are cut in a curved line. The pattern A6 refers to a case where the neckline of the pattern A5 is cut into a U-shape, the sleeves thereof are cut into a non-sleeve form, and the bottom thereof is cut in a straight line. The pattern A7 refers to a case where the neckline of the pattern A6 is cut into a modified U-shape, an arc-shaped cut is provided in one side of the bodies thereof, and the bottom thereof is cut short in a straight line. The pattern A8 refers to a case where the neckline of the pattern A7 is cut even deeper and the total length thereof is cut short to the bottom of the bust.

Figure 3:
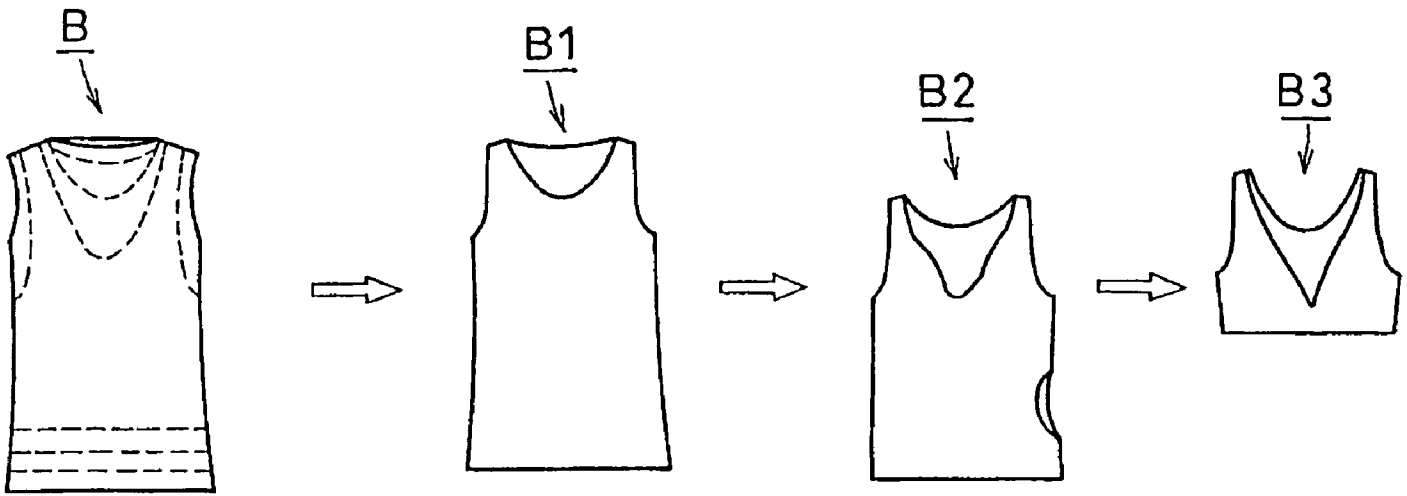
FIG. 3 is a similar illustrative diagram for a non-sleeve shirt type.

FIG. 3 shows cuttable design models displayed on the wrapping paper or board of the non-sleeve shirt type garment by printing or the like, expressing possible transition from the original pattern B to modified patterns B1, B2, and B3. The pattern B1 refers to a case where the neckline of the original pattern B is cut into a U-shape and the bottom thereof is cut short in a straight line. The pattern B2 refers to a case where the neckline of the pattern B1 is cut into a modified U-neck shape, an arc-shaped cut is provided in one side of the bodies thereof, and the bottom thereof is cut short in a straight line. The pattern B3 refers to a case where the neckline of the pattern B2 is cut even deeper and the total length thereof is cut short to the bottom of the bust.

Figure 4:
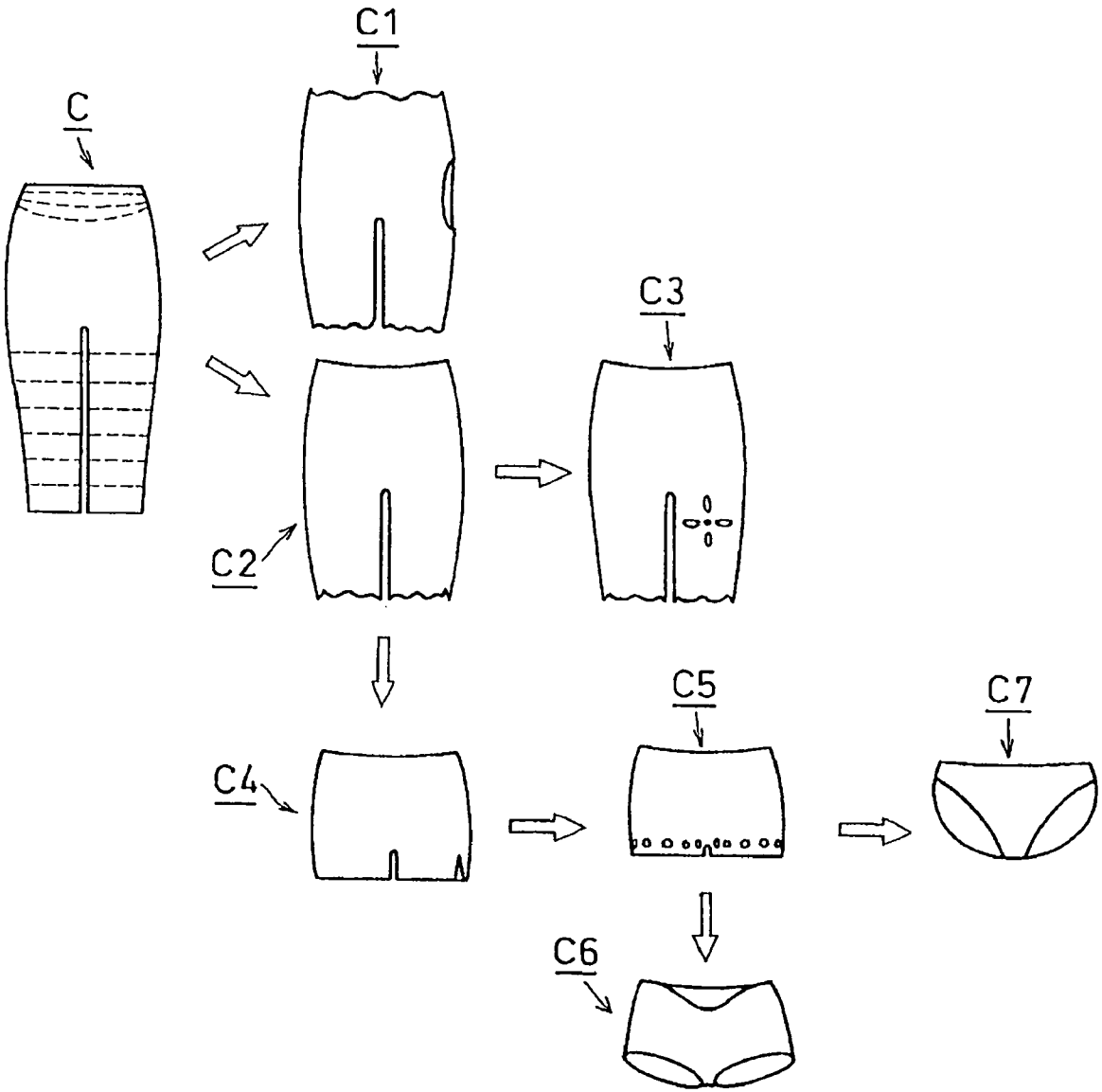
FIG. 4 is a similar illustrative diagram for a long-length panty type.

FIG. 4 shows cuttable design models displayed on the wrapping paper or board of the long-length panty type garment by printing or the like, expressing possible transition from the original pattern C to modified patterns C1, C2, and C3 and further to modified patterns C4, C5, C6, and C7. The pattern C1 refers to a case where an opening part of a waist girth of the original pattern C is cut in a waved curve, the bottoms thereof is cut in a waved curve, and an arc-shaped cut is provided in one side thereof. The pattern C2 refers to a case where the opening part of the waist girth of the original pattern C is cut into a gentle arc shape and the bottoms thereof are cut in a waved curve. The pattern C3 refers to a case where a floral-patterned cut is provided in one of leg parts of the pattern C2. The pattern C4 refers to a case where the bottoms of the pattern C2 are cut short into the shape of shorts and a V-shaped cut is provided in one of the bottoms thereof. The pattern C5 refers to a case where the bottoms of the pattern C4 are cut even shorter and small-hole-patterned cuts are provided in the bottom circumference thereof. The pattern C6 refers to a case where an opening part of a waist girth of the pattern C5 on only the front body side is cut into a U-shape and the bottoms thereof are cut even shorter. The pattern C7 refers to a case where the opening part of the waist girth of the pattern C5 and an opening part of the bottom circumference thereof are largely cut into the shape of shorts.

Figure 5:
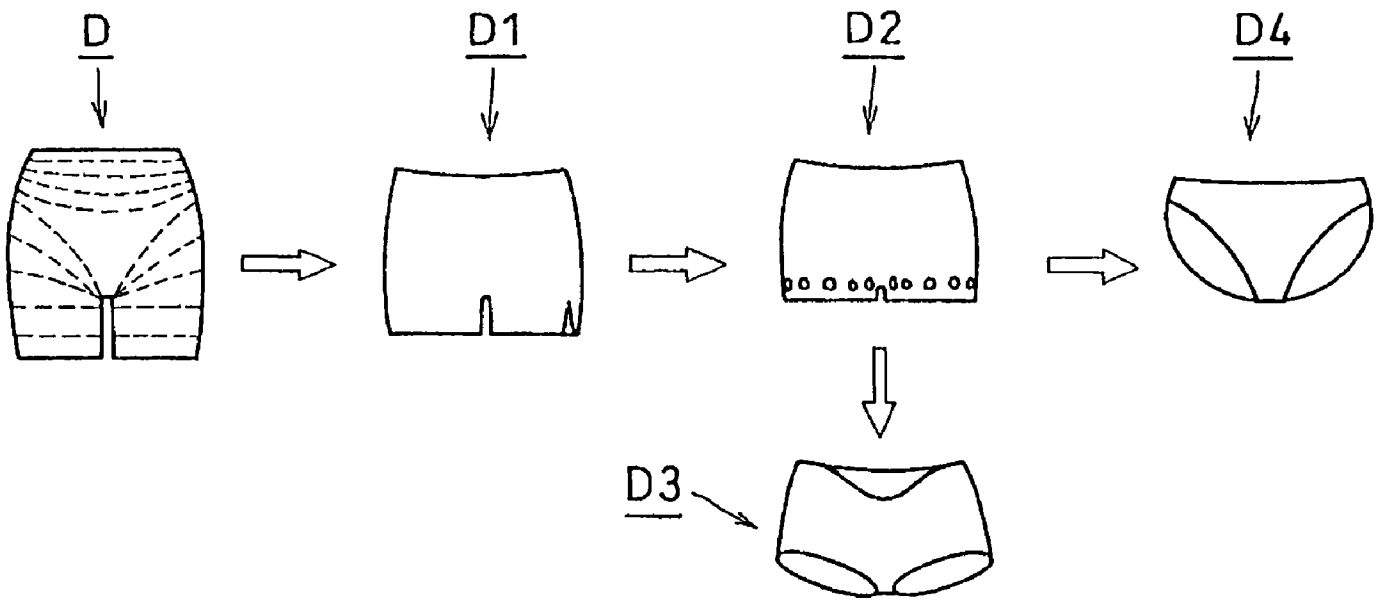
FIG. 5 is a similar illustrative diagram for a half-length panty type.

FIG. 5 shows cuttable design models displayed on the wrapping paper or board of the half-length panty type garment by printing or the like, expressing possible transition from the original pattern D to modified patterns D1, D2, D3, and D4. The pattern D1 refers to a case where an opening part of a waist girth of the original pattern D is cut into a gentle arc shape, bottoms thereof are cut short into the shape of short pants, and a V-shaped cut is provided in one of the bottoms thereof. The pattern D2 refers to a case where the bottoms of the pattern D1 are cut even shorter and small-hole-patterned cuts are provided in the bottom circumference thereof. The pattern D3 refers to a case where an opening part of a waist girth of the pattern D2 on the front body side only is cut into a U-shape and the bottoms thereof are cut even shorter. The pattern D4 refers to a case where the opening part of the waist girth and opening parts of the bottom circumference of the pattern D2 are largely cut into the shape of shorts.

The wrapping paper or board on which the cuttable design models are displayed by printing or the like is provided in a form corresponding to the folded shape of each garment original pattern, and is exemplified by a rectangular bag or a rectangular board. It is preferable that the display is provided on the back side for the wrapping paper and on the front side for the board, although not limited thereto. The aforementioned display is provided on at least one or both of the wrapping paper and board. Printing on these wrapping paper and board may be achieved by normal printing.

The respective original patterns for the garments described above are either folded on the board and then wrapped in the wrapping paper or wrapped in the wrapping paper while omitting the board to be sold as a set. The consumer can purchase this and, with reference to the cut lines and the design models, for the shirt-type garments, can cut the neckline into any size and shape to form a desired neckline and collar circumference shape and can cut the total length and the sleeve length in any shape, such as a straight line, curved line, tilted line, or the like, at any position to form a desired bottom shape (hem line) and sleeve shape (for example, three-quarter sleeve, half-sleeve, non-sleeve, or the like). Moreover, for the panty type garments, the consumer can cut the total length and the rise length in any shape, such as straight line, curved line, tilted line, or the like, at any height position of the waist girth and any height position of the leg part to thereby form a desired total length and waist line and also can cut it in any shape, such as straight line, curved line, tilted line, or the like, at any height position from the bottom to thereby form a desired bottom shape ranging from short pants to shorts.

The cut lines provided on the garments and the cuttable design models provided on the wrapping paper or the board may be embodied by modification of those illustrated. Moreover, one or both of the cut lines provided on the garment and the design models provided on the wrapping paper or the board may be embodied. The original pattern for the garment is applicable to underwear, sweaters, trousers, pants, intermediate garments, upper garments, and various ladies' and men's garments.

FIG. 6 shows one example of dimensions and sizes of the different parts with respect to the original patterns and standard products for the respective garments.

Figure 7:
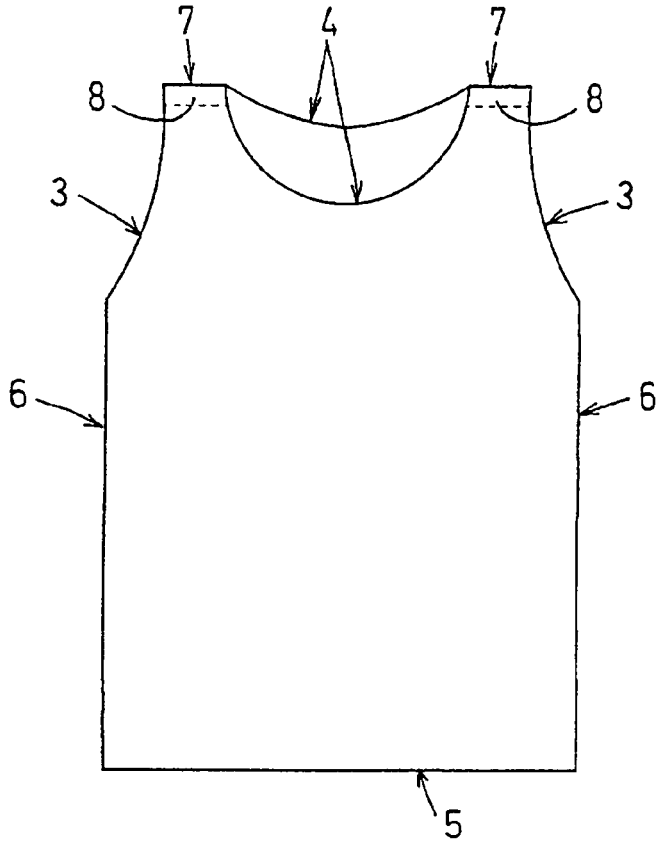
FIG. 7 is a schematic elevation view of another embodiment of the garment according to the present invention.

Next, FIG. 7 refers to a sleeveless undershirt to which the present invention is applied, where a front body 1 and a back body 2 are formed of one cylindrical fabric cut along predetermined cutting lines into a plurality of pieces (not shown), armhole parts 3, neckline parts 4, and lower end bottom circumference parts 5 are formed, flank parts 6 are continuous, only shoulder parts 7 are provided as fabric seaming parts 8.

Used as the fabric described above is knitted fabric having a fray-preventing function. The knitted fabric provided with a fray-preventing function is woven with heat-welding elastic yarn and a different type of yarn by plating stitch. As the heat-welding elastic yarn, low melting polyurethane elastic yarn is used.

The plating stitch is a method of feeding a plurality of types of yarn to a knitting needle through different yarn-feeding openings, and serves to stably define arrangement of the yarn of each of the organized loops. Therefore, the plating-knitted fabric woven by feeding the heat-welding elastic yarn and the different type of yarn to the knitting needle through the different yarn-feeding openings, due to its stable arrangement of the heat-welding elastic yarn and the different type of yarn in each knitted loop, can locate the heat-welding elastic yarn adjacent to all the loops. Thus, additionally providing it with fray-preventing function by melting the heat-welding elastic yarn through heat setting processing or the like advantageously provides a complete fray-prevention for all the loops of the knitted fabric.

The knitted fabric used in the present invention is, for example, formed into thin, weft-knitted fabric as fraise (1×1 rib-knitted) or any of other stockinet by a circular knitting machine or any of other types of knitting machines.

Upon forming cylindrical fabric by the circular knitting machine described above, a portion as a lower end of undershirt for the undershirt fabric and a portion as an upper end of pants for the pants fabric may be cut in a straight line. Also, since a cut position of the cylindrical fabric is previously determined for each predetermined length, for each predetermined length of the cylindrical fabric in a cylindrical direction (longitudinal direction) thereof, the cylindrical fabric knitted and finished with water-soluble nylon yarn inserted therein may be soaked in water to elute and remove the water-soluble nylon yarn to be thereby separated as a fray-preventing linearly cut-off hem.

Figure 8:
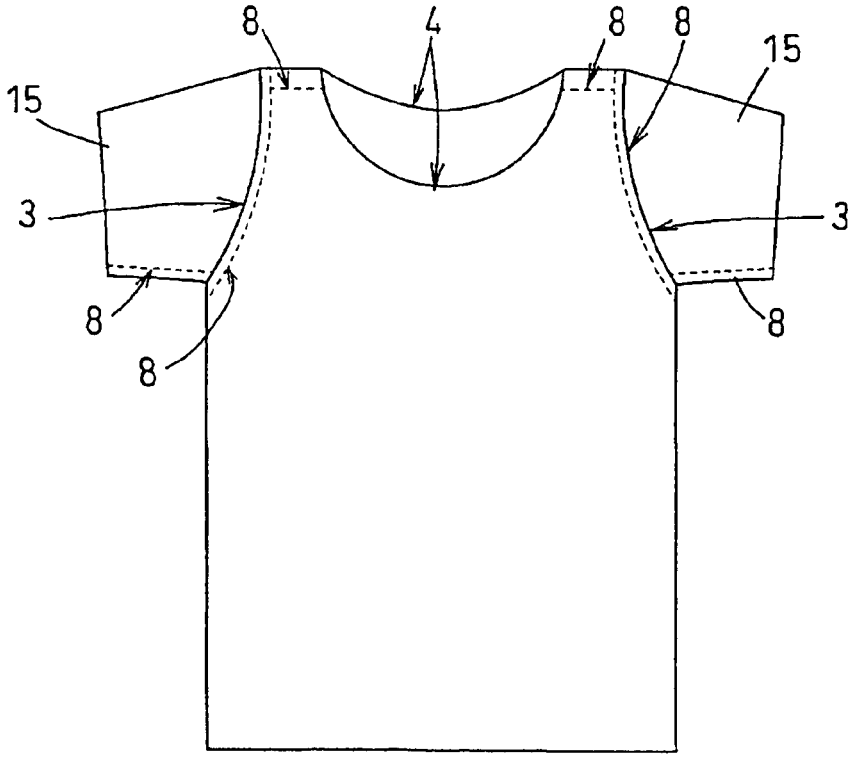
FIG. 8 is a schematic elevation view of another embodiment of the garment according to the present invention.

FIG. 8 refers to a half-sleeve type undershirt to which the present invention is applied, and differs from FIG. 7 in that sleeve portions 15 are seamed together with armhole parts 3 by sewing or bonding, while other portions of FIG. 8 have the same configuration as those of FIG. 7. The portions with the same configuration are numbered with the same numerals and omitted from description.

Figure 9:
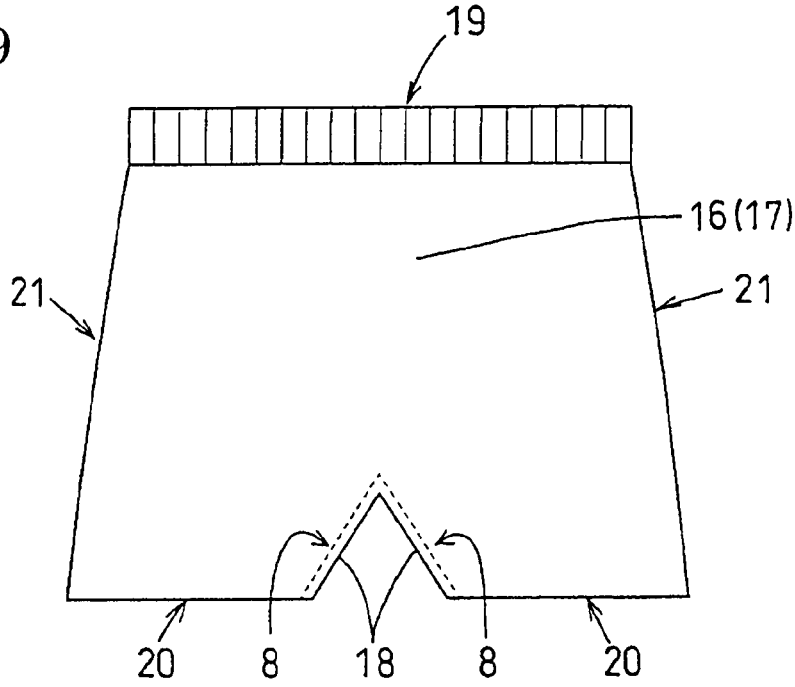
FIG. 9 is a schematic elevation view of still another embodiment of the garment according to the present invention.

FIG. 9 refers to trunks-type pants to which the present invention is applied, where a front body 16 and a back body 17 are formed of one cylindrical fabric cut along predetermined cutting lines at equal intervals in a longitudinal direction of the fabric, a crotch part 18, a waist girth part 19, and leg circumference parts 20 are formed, both side parts 21 are continuous, and only the crotch part 18 is provided as a fabric seaming part 8. Also in this case, the fabric seaming part 8 is sewn or bonded. Configurations of other portions are the same as those of FIG. 7. The waist girth part 19, in knitting process by the circular knitting machine, by increasing the heat-welding elastic yarn for knitting, may be knitted by inserting portions knitted with larger stretch properties than the other portions at equal intervals in the longitudinal direction of the fabric. This permits omitting the labor of sewing a rubber tape, inserting a rubber string, or the like for the waist girth part 19.

Figure 10:
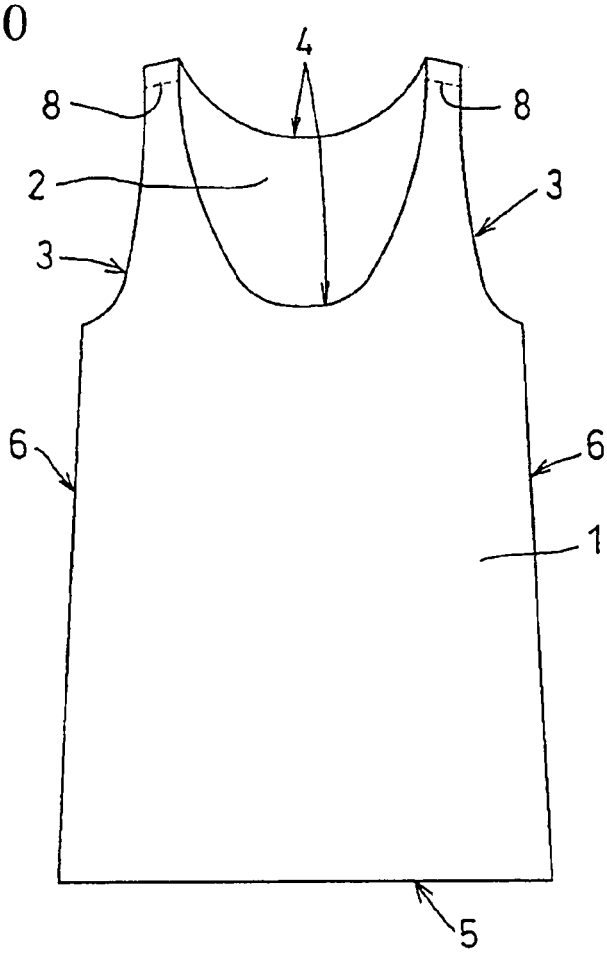
FIG. 10 is a schematic elevation view of another embodiment of the garment according to the present invention.

FIG. 10 refers to a ladies' non-sleeve undershirt to which the present invention is applied. Also in this case, as is the case with FIG. 7, the front body 1 and the back body 2 are cut from one cylindrical fabric, the armhole parts 3, the neckline parts 4, and the lower bottom end circumference parts 5 are formed, the flank parts 6 are continuous, only shoulder parts 7 are provided as fabric seaming parts 8 and sewn or bonded. The fabric used is the same as that of FIG. 7.

Figure 11:
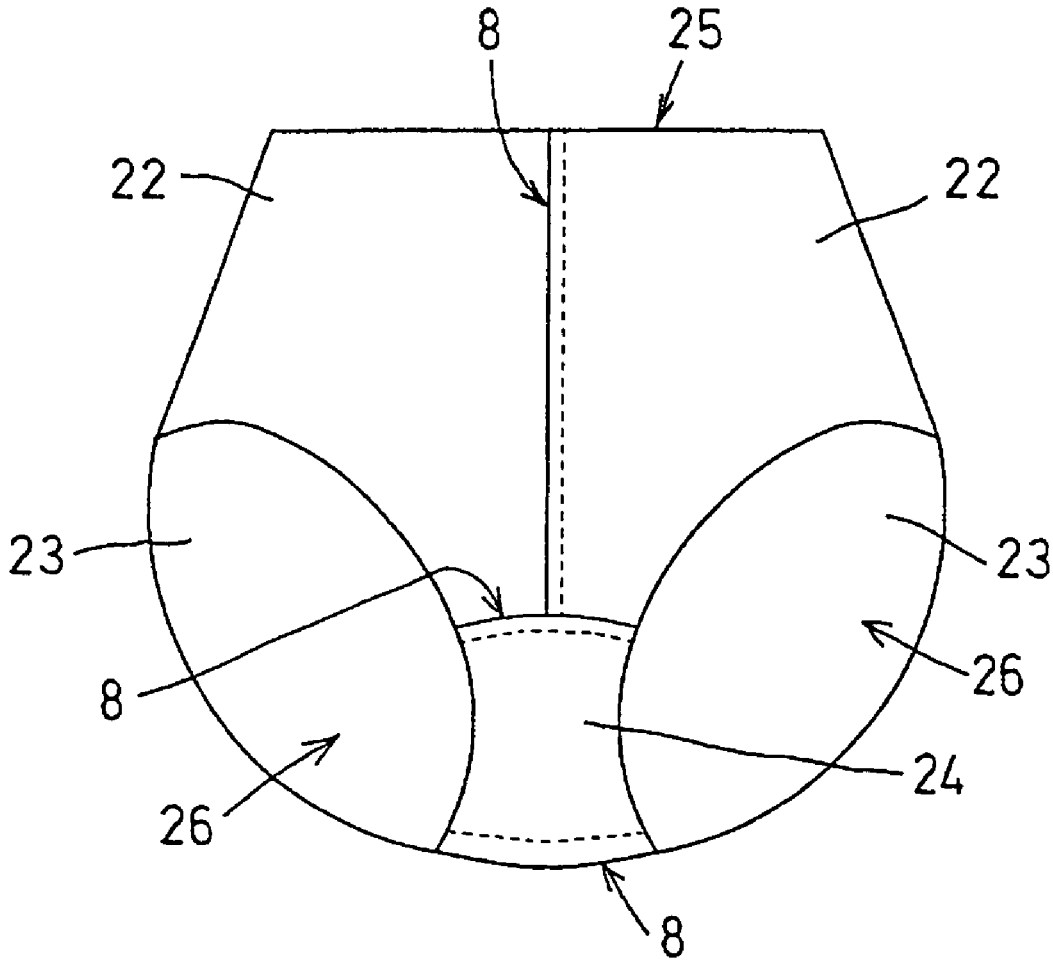
FIG. 11 is a schematic elevation view of still another embodiment of the garment according to the present invention.

FIG. 11 refers to ladies' shorts to which the present invention is applied. In this case, a front body 22 and a back body 23 are continuous, but they are cut in a form such that they are separated and spread at a central portion of the front back 22, a crotch part 24 is separately cut, the right and left ends of the front body 22 are first superposed on each other to form a vertical seaming part 8, then a front end of the crotch part 24 and a lower center end of the front body 22 are superposed on each other to form a seaming part 8, and a back end of the crotch part 24 and a lower center end of the back body 23 are superposed on each other to form the seaming part 8, thereby forming an upper end waist girth part 25 and leg circumference parts 26 as opening parts. Also in this case, the seaming parts 8 are sewn or bonded respectively. The fabric used is the one, as in FIG. 7, knitted with plating-knitted fabric by the circular knitting machine.

In each of the embodiments of FIGS. 7 to 11, the present invention is a garment which is made by providing plating-knitted fabric, woven by the feeding heat-welding elastic yarn and a different type of yarn to a knitting needle through different yarn-feeding openings, with a fray-preventing function through heat setting processing or the like and then cutting the plating-knitted fabric into a shape and dimension in accordance with a corresponding design, and which has cut-off opening parts. The opening parts of the garment formed of the plating knitting fabric provided with a fray-preventing function in this manner can eliminates the need for troublesome fray-preventing after treatment since edges of the opening parts do not fray even when left with cut-off design. Moreover, seaming parts of the garment can be seamed through heating and pressurization by an iron or the like with a heat-welding tape or the like laid therebetween, which can eliminates the need for sewing processing. Joining of the seaming parts through such welding results in a larger joining area than is provided by joining with stitches of sewing yarn, and thus can improve a joining strength. Moreover, bulkiness of the seaming parts can be reduced, thus permitting the seaming part to become less outstanding through an outer garment. In this manner, the garment of the present invention can have opening parts with cut-off design and have thinner seaming parts; therefore, the garment of the present invention can greatly improve wear feeling of a conventional garment, which permits providing a garment also excellent in fashionability.

The fabric used in the embodiments of FIGS. 7 to 11 may be fabric knitted by the plain knitting machine and used with a front body and a back body seamed together at the both side parts. Moreover, this fabric is also applicable to various underwear and other types of garments in a form other than that shown.

The embodiment of the present invention is described above, although not limited thereto, and thus various modifications may be made within a range described in the scope of the claims.

INDUSTRIAL APPLICABILITY

The present invention is applicable to underwears, sweaters, trousers, pants, intermediate garments, upper garments, various types of ladies' and men's garments.

The invention claimed is:

1. A freely cuttable garment in combination with a cuttable design model, comprising:

the garment formed of a whole knitted fabric having a fray-preventing function and composed of an original pattern in which the whole knitted fabric is knitted with a heat-welding polyurethane elastic yarn and other spun yarn or a filament yarn by plating stitch, and the whole knitted fabric is provided through heat setting processing, a size of an opening part of at least one of a neckline part and an armhole part in the original pattern of the garment is smaller than the size of the opening part after the garment is cut, wherein:

at least one of a total length and a sleeve length in the original pattern of the garment is larger than the length after the garment is cut, a body width in the original pattern of the garment is equal to a body width after the garment is cut, in the original pattern of the garment of an upper half body, one or a plurality of cut lines are displayed on either of back and front sides of the garment, for cutting the opening of at least one of the neckline part and the armhole part to make larger, or one or the plurality of cut lines are displayed on either of the back and front side of the garment, for cutting at least one of the total length and the sleeve length to make shorter, the garment for the upper half body is a long-sleeve shirt type, a shoulder part of the garment for the upper half body is a seaming part which is a seam by heat welding means, and the cuttable design model printed on wrapping paper or a board and wrapped together with the garment as a set, wherein the printing on the wrapping paper or the board is expressed in transition including:

in the long-sleeve shirt type, from a half-sleeve shirt pattern to a non-sleeve shirt pattern by cutting the sleeve length and the total length of the original pattern short, and by further cutting the neckline thereof into a V-neck shape or a U-neck shape.

2. A freely cuttable garment in combination with a cuttable design model, comprising:

the garment formed of a whole knitted fabric having a fray-preventing function and composed of an original pattern in which the whole knitted fabric is knitted with a heat-welding polyurethane elastic yarn and other spun yarn or a filament yarn by plating stitch, and the whole knitted fabric is provided through heat setting processing, wherein:

at least one of a total length and a rise length in the original pattern of the garment is larger than the length after the garment is cut, a body width and a waist girth in the original pattern of the garment are equal to those after the garment is cut, in the original pattern of the garment of a lower half body, one or a plurality of cut lines are displayed on either of back and front sides of the garment, for providing an arc-shaped cut around an opening of the waist girth, or one or the plurality of cut lines are displayed on either of back and front sides of the garment, for cutting a leg part to make shorter, the garment for the lower half body is a long-length panty type, at least one of both sides and crotch parts of the garment for the lower half body is a seaming part which is a seam by heat welding means, and the cuttable design model printed on wrapping paper or a board and wrapped together with the garment as a set, wherein the printing on the wrapping paper or the board is expressed in transition from a half-length shape to a short-panty shape, and from the short-panty shape to a shorts shape, including:

in the long-length panty type, by cutting the opening of the waist girth with an arch-shaped and by cutting the leg part short.

3. A freely cuttable garment in combination with a cuttable design model, comprising:

the garment formed of a whole knitted fabric having a fray-preventing function and composed of an original pattern in which the whole knitted fabric is knitted with a heat-welding polyurethane elastic yarn and other spun yarn or a filament yarn by plating stitch, and the whole knitted fabric is provided through heat setting processing, wherein:

a size of an opening part of at least one of a neckline part and an armhole part in the original pattern of the garment is smaller than the size after the garment is cut, at least one of a total length and a sleeve length in the original pattern of the garment is larger than the length after the garment is cut, a body width in the original pattern of the garment is equal to a body width after the garment is cut, in the original pattern of the garment of an upper half body, one or a plurality of cut lines are displayed on either of back and front sides of the garment, for cutting the opening of at least one of the neckline part and the armhole part to make larger, or one or the plurality of cut lines are displayed on either of the back and front side of the garment, for cutting at least one of the total length and the sleeve length to make shorter, the garment for the upper half body is a non-sleeve shirt type, a shoulder part of the garment for the upper half body is a seaming part which is a seam by heat welding means, and the cuttable design model printed on wrapping paper or a board and wrapped together with the garment as a set, wherein the printing on the wrapping paper or the board is expressed in transition including:

in the non-sleeve shirt type, by cutting the total length of the original pattern short, and cutting the neckline thereof into the U-neck shape or the V-neck shape, and further cutting the opening part of the armhole part larger.

4. A freely cuttable garment in combination with a cuttable design model, comprising:

the garment formed of a whole knitted fabric having a fray-preventing function and composed of an original pattern in which the whole knitted fabric is knitted with a heat-welding polyurethane elastic yarn and other spun yarn or a filament yarn by plating stitch, and the whole knitted fabric is provided through heat setting processing, wherein:

at least one of a total length and a rise length in the original pattern of the garment is larger than the length after the garment is cut, a body width and a waist girth in the original pattern of the garment are equal to those after the garment is cut, in the original pattern of the garment of a lower half body, one or a plurality of cut lines are displayed on either of back and front sides of the garment, for providing an arc-shaped cut around an opening of the waist girth, or one or the plurality of cut lines are displayed on either of back and front sides of the garment, for cutting a leg part to make shorter, the garment for the lower half body is a half-length panty type, at least one of both sides and crotch parts of the garment for the lower half body is a seaming part which is a seam by heat welding means, and the cuttable design model printed on wrapping paper or a board and wrapped together with the garment as a set, wherein the printing on the wrapping paper or the board is expressed in transition from a short-panty shape to a shorts shape, including:

in the half-length panty type, by cutting the opening part of the waist girth with an arch-shaped and by cutting the leg part short.

* * * * *